US012379146B2

(12) United States Patent
Lehman

(10) Patent No.: US 12,379,146 B2
(45) **Date of Patent: *Aug. 5, 2025**

(54) METHOD AND SYSTEM FOR COOLER CONVERSION TO A REFRIGERATOR

(71) Applicant: Adam Lehman, Santee, CA (US)

(72) Inventor: Adam Lehman, Santee, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/376,079

(22) Filed: Oct. 3, 2023

(65) Prior Publication Data

US 2024/0027123 A1 Jan. 25, 2024

Related U.S. Application Data

(63) Continuation of application No. 17/483,910, filed on Sep. 24, 2021, now Pat. No. 11,774,160, which is a continuation of application No. 16/252,935, filed on Jan. 21, 2019, now Pat. No. 11,131,495.

(51) Int. Cl.
*F25D 11/00* (2006.01)
*F25D 19/00* (2006.01)

(52) U.S. Cl.
CPC ..... *F25D 11/003* (2013.01); *F25D 19/003* (2013.01); *F25D 2400/38* (2013.01)

(58) Field of Classification Search
CPC ..... F25D 11/003
See application file for complete search history.

(56) References Cited

U.S. PATENT DOCUMENTS

| | | | | |
|---|---|---|---|---|
| 5,345,775 | A | 9/1994 | Ridenour | |
| 10,670,322 | B2 | 6/2020 | Eddy | |
| 11,131,495 | B2 | 9/2021 | Lehman | |
| 11,774,160 | B2 * | 10/2023 | Lehman | F25D 11/003 62/237 |
| 2008/0156034 | A1 | 7/2008 | Cur | |
| 2019/0152677 | A1 | 5/2019 | Hoyt | |

OTHER PUBLICATIONS

"Engel Ice Box Conversion Kit," Nov. 2, 2012 (Year: 2012).
Duncan Kent, "How to: Upgrading your Icebox," Nov. 9, 2018 (Year: 2018).

* cited by examiner

*Primary Examiner* — Christopher R Zerphey
(74) *Attorney, Agent, or Firm* — Vitale, Vickrey, Niro, Solon & Gasey, LLP

(57) ABSTRACT

A method and system for converting a conventional cooler to a refrigerator. A heat transfer module is disposed within the cooler for cooling the contents therein, while an external cooling module includes refrigerant in a closed loop configuration that stays outside of the cooler. The heat transfer module includes a closed loop chilling fluid that extends outside the cooler through a drain port to perform a heat exchange with the refrigerant loop.

3 Claims, 3 Drawing Sheets

Scale: 1:6

Scale: 1:6

Scale 1:10

Scale 1:10

Scale 1:4

Scale 1:6

Scale 1:6

Scale 1:6

Scale 1:6

Scale 1:6

METHOD AND SYSTEM FOR COOLER CONVERSION TO A REFRIGERATOR

FIELD OF INVENTION

The present invention relates to a system and method for the conversion of a cooler to a refrigeration unit. More specifically, the present invention relates to a modular system for a non-HVAC specialist to insert components of a refrigeration system into the interior of a cooler so as to create a thermal transfer section therein, with a closed loop fluid communication pathway extending from the thermal transfer section through the cooler drain to a fluid cooling module outside the cooler containing the remaining components of the refrigeration system, as well as a second closed loop holding refrigerant for engaging in a heat exchange with the closed loop fluid.

BACKGROUND OF THE INVENTION

No one likes a soggy sandwich. Unfortunately, for outdoor and transient environments, the only practical way to keep spoilable goods chilled is through a chest or cooler filled with ice. Ultimately, given the melting of such ice, the cooler contents can become compromised, either through the water contamination due to melted ice and/or loss of chilling capacity from melting. Portable refrigerators are known in the art, though such systems have their own inherent limitations. For one, such systems can be expensive and/or require a significant degree of technical acumen to set up and implement in a cooler application. Another limitation is the lack of practical portability—most portable refrigerators do not have battery power support and/or mechanisms for DC power supply from a portable source, such as a car adapter. In addition, the refrigeration components typically occupy a significant amount of space that decreases the internal capacity of the unit.

In order to provide a usable product for a providing a conversion from a typical cooler to a refrigerator, it is necessary to provide a mechanism to enable the use of a refrigeration system having a smaller footprint in terms of the space occupied in a cooler. In addition, it is also necessary to have the system be convertible and modular, i.e., to be able to convert the cooler between refrigeration and (conventional) cooler operation without undue difficulty or technical expertise.

DESCRIPTION OF THE PRIOR ART

Prior art portable refrigeration systems are known to those of skill. An example of portable refrigerator technology is taught in U.S. Pat. No. 2,532,234 (Kimble), which shows a contained box like structure including a single loop containing refrigerant (such as Freon), as well as the conventional components of a refrigeration unit (e.g., condenser, compressor, etc.) all disposed inside the unit in a single module. Such configurations do not lend themselves to leaving much storage space for goods to be refrigerated, nor do they lend themselves to ease of retrofit or conversion to turn a cooler into a refrigerator. Moreover, with the jarring that can occur with mobile usage (e.g., on a campout), this configuration could wind up creating a leak of refrigeration inside the unit, thus destroying the contents and creating a hazard for the user and or the environment.

Another approach is discussed in U.S. Pat. No. 4,356,708 (Horton) which describes a marine refrigeration system including a holding plate in the form of a small tank with a removable lid. A set of flanges are formed integrally with the cover, preferably of heavy cast aluminum, and project into the interior of the tank. A cooling coil carries refrigerant that is wrapped around an outer surface of the flanges to provide contact between the coil and the flanges. The tank is preferably filled with a liquid that surrounds the coil and serves as a cold reservoir. The tank is also preferably located within an insulating cabinet and is spaced from the walls of the cabinet to create a zone for conventional refrigeration. As with Kimble, however, Horton fails to teach or suggest separating a refrigerant loop separate from the interior of the cooler. Also, Horton fails to teach a system that can be adapted for use with conventional coolers.

In sum, none of these prior art approaches permit a refrigeration system to be installed in a convention cooler without the assistance of an HVAC expert or technician. Additionally, none of these prior art approaches permit the removal of a refrigeration system for conventional cooler operation without the assistance of an HVAC expert or technician.

What is needed is a modular, easily installed, and easily removed refrigeration unit that minimizes the "footprint" of cooler space occupied, while converting a cooler to a refrigerator and allowing for conversion back without undue weight, loss of mobility, or the assistance of a licensed technician.

DEFINITION OF TERMS

The following terms are used in the claims of the patent as filed and are intended to have their broadest plain and ordinary meaning consistent with the requirements of the law.

A "cooler" includes an icebox, a portable cooler, or portable chest insulated container for keeping food and drink and other spoilable items cool.

A "drain port" includes pre-existing apertures as well as retrofitted apertures located in a cooler wall.

Where alternative meanings are possible, the broadest meaning is intended. All words used in the claims set forth below are intended to be used in the normal, customary usage of grammar and the English language.

OBJECTS AND SUMMARY OF THE INVENTION

The apparatus and method of the present invention generally includes a refrigeration unit comprising a heat transfer module placed inside of the cooler and a liquid cooling module placed outside of the cooler, where the heat transfer module includes at least the radiator for cooling the air inside of the cooler, while the outside liquid cooling module includes at least the condenser, a refrigerator compressor, an evaporator, and a throttling device associated with a typical refrigeration unit. In a most preferred embodiment, the internal heat transfer module also includes a liquid pump, and a liquid reservoir, though alternative embodiments may place such components with the outside liquid cooling module. The internal heat transfer module includes a liquid in a closed loop that traverses the drain port of the cooler from the internal module to the external module where it passes and enters into a heat exchange process with a second closed fluid loop on the external liquid cooling module, the second loop containing a typical, commercially available refrigerant.

The immediate application of the present invention will be seen in the use of conversion kits for turning conventional coolers into refrigerators for portable, battery powered use, though those of skill will see that the present invention could be applied to other applications that employ an external DC power supply where existing portable refrigerators may not be practical.

Thus, it can be seen that one object of the present invention is to provide a modular, easily installed, and easily removed refrigeration unit for retrofitting a conventional cooler.

Still a further object of the present invention is to provide modular refrigeration kit that minimizes the space occupied by the system inside of the cooler.

Still another object of the present invention is to provide portable cooler to refrigeration system that avoids the exposure of refrigerant inside of the cooler.

It should be noted that not every embodiment of the claimed invention will accomplish each of the objects of the invention set forth above. In addition, further objects of the invention will become apparent based on the summary of the invention, the detailed description of preferred embodiments, and as illustrated in the accompanying drawings. Such objects, features, and advantages of the present invention will become more apparent in light of the following detailed description of a best mode embodiment thereof, and as illustrated in the accompanying drawings.

DETAILED DESCRIPTION OF THE INVENTION

Set forth below is a description of what is currently believed to be the preferred embodiment or best examples of the invention claimed. Future and present alternatives and modifications to this preferred embodiment are contemplated. Any alternatives or modifications which make insubstantial changes in function, in purpose, in structure or in result are intended to be covered by the claims in this patent.

Figure 1:
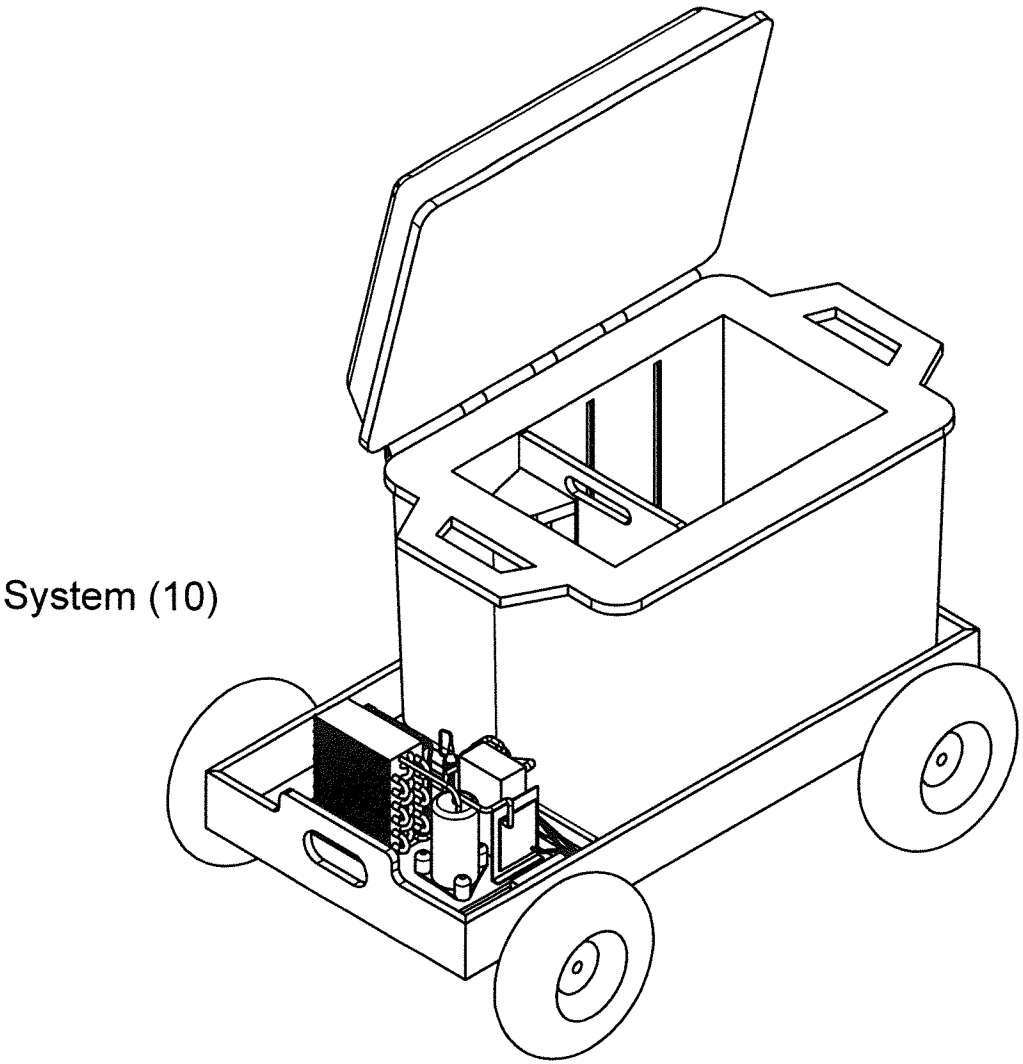
FIG. 1 shows a perspective drawing of a system employing an embodiment of the refrigeration conversion system of the present invention.
Figure 2B:
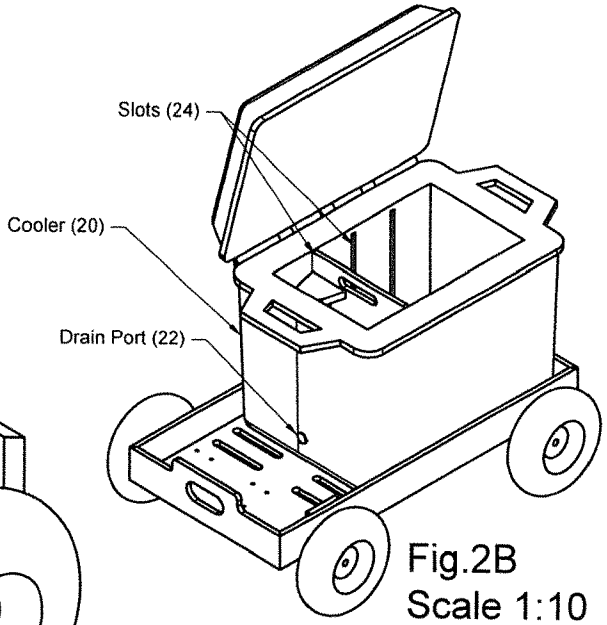
FIG. 2B shows an exposed perspective view showing drain port and slot features of a preferred embodiment of the present invention.
Figure 2C:
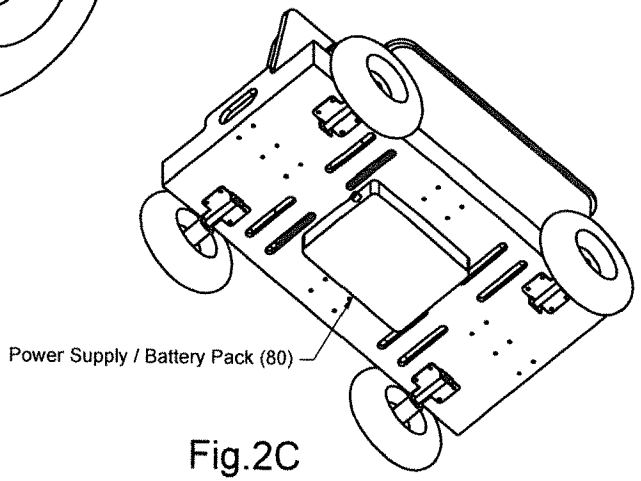
FIG. 2C shows a bottom perspective view of a system fitted with an embodiment of the refrigeration conversion system of the present invention including a power supply component.
Figure 2A:
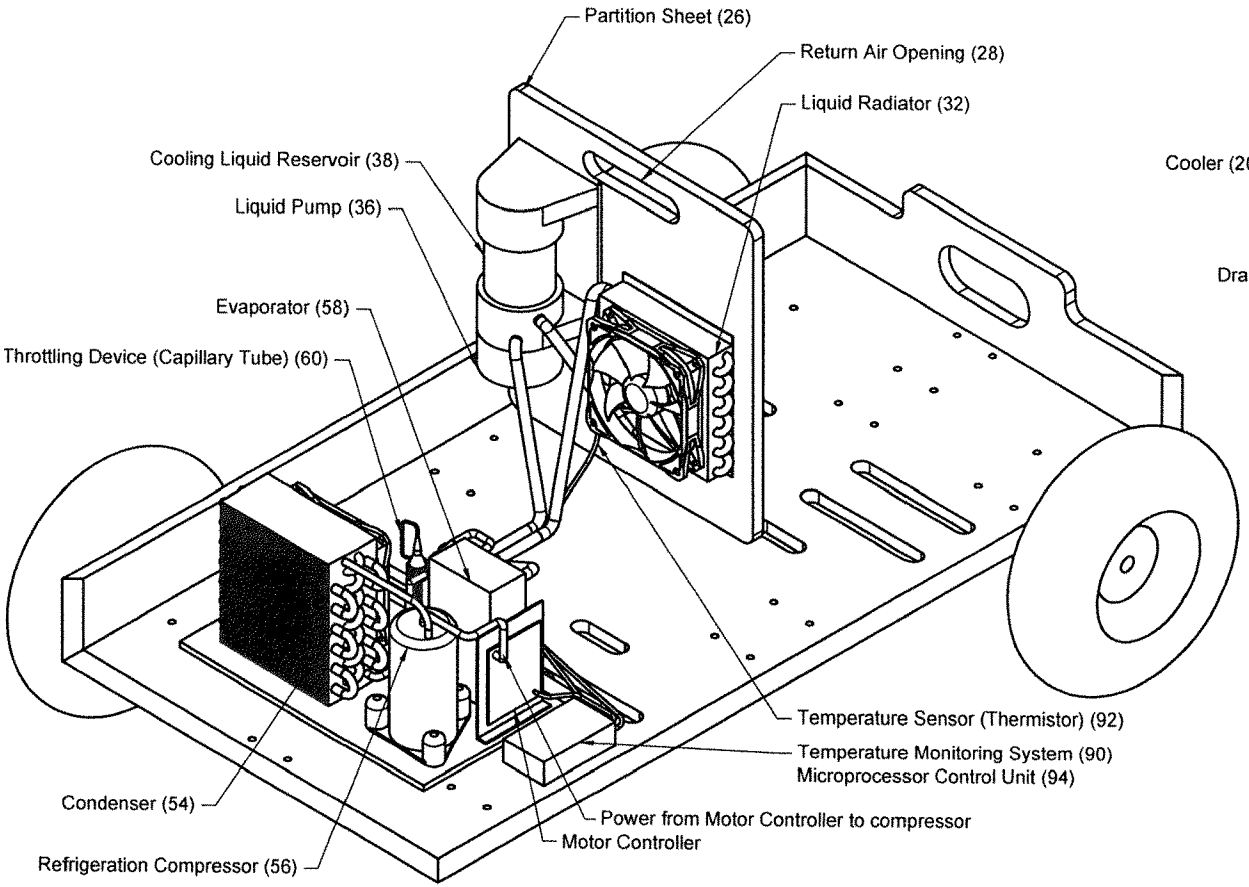
FIG. 2A shows a perspective view of components to be used with a conventional cooler fitted with an embodiment of the refrigeration conversion system of the present invention.
Figure 3A:
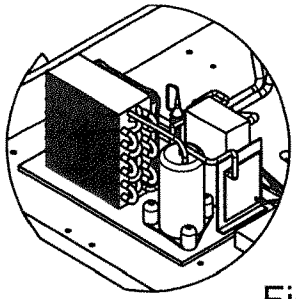
FIG. 3A shows condenser, compressor and evaporator components of a system employing an embodiment of a refrigeration conversion system of the present invention.
Figure 3B:
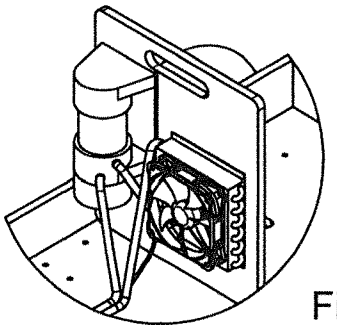
FIG. 3B shows heat exchange module and cooling liquid loop details of a system employing an embodiment of a refrigeration conversion system of the present invention.
Figure 3C:
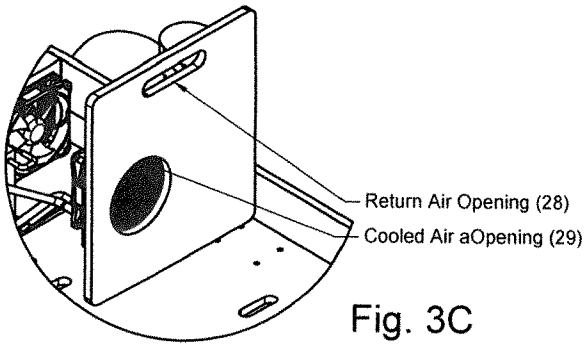
FIG. 3C shows an exposed interior detail of cooled air and return air opening details of a system employing an embodiment of a refrigeration conversion system of the present invention.
Figure 3D:
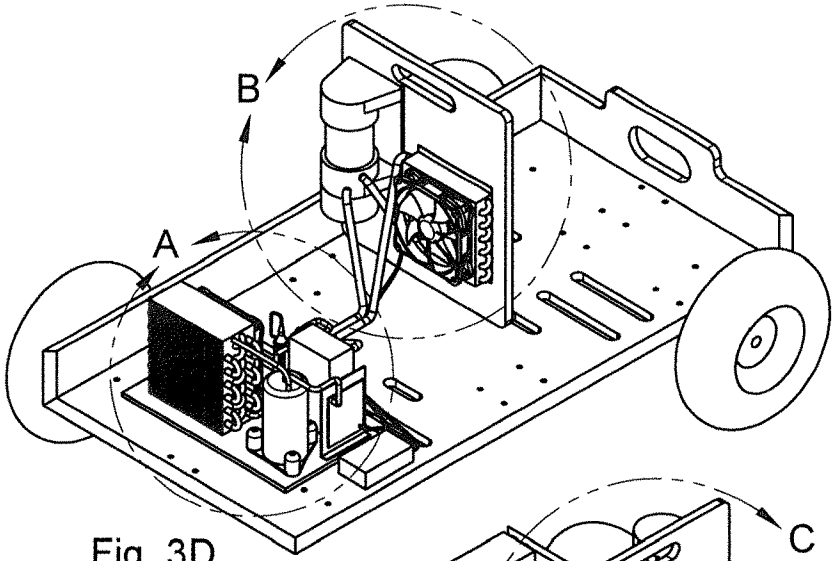
FIG. 3D shows a perspective exposed view of the system employing an embodiment of the present invention including the details from FIGS. 3A and 3B.
Figure 3E:
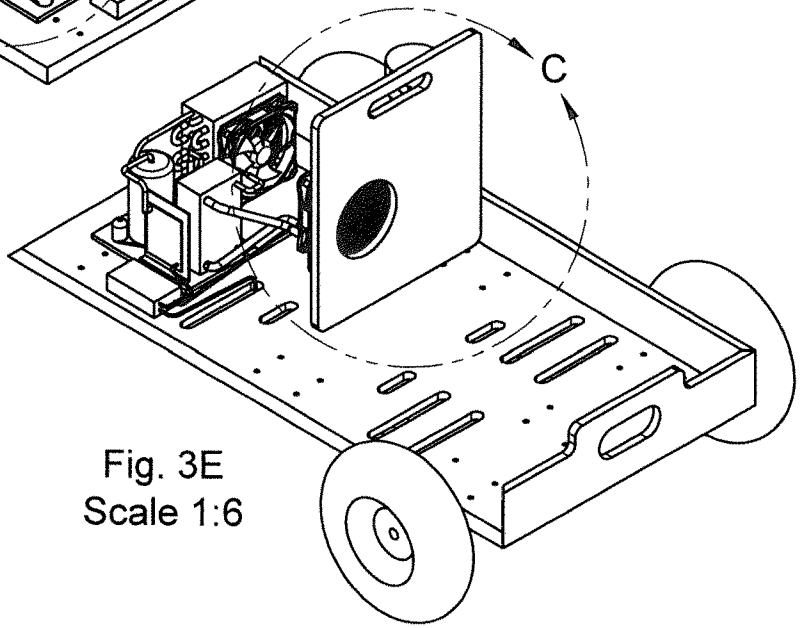
FIG. 3E shows the details of the system of FIG. 3D rotated to more clearly show the detail of FIG. 3C.

FIGS. 1, 2A-2C and 3A-3C show a first preferred embodiment of the system 10 employed with a cooler 20, the system including a heat exchange module 30 and a liquid cooling module 50. The cooler 20 most preferably includes a drain port 22, and a series of notches or slots 24 for receiving a partition sheet 26 which has a return air opening 28 to allow for the circulation of air from the interior of the cooler 20 through the heat exchange module 30, then back to the rest of the interior of the cooler 20 through the cooled air opening 29. As shown in this preferred embodiment, the heat exchange module 30 of this embodiment includes an internal fan and radiator 32 for transmitting air through the cooled air opening 29 of the partition sheet, as well as a cooling liquid loop 34 comprised of a flexible hose or similar conduit, a liquid pump 36 for circulating the cooling liquid and a cooling liquid reservoir 38. The liquid employed in this loop is most preferably a propylene glycol type fluid, though those of skill in the art will understand that other, equivalent fluids may be used with comparable efficacy.

Additionally, those of skill in the art having this invention will understand that the present disclosure could support at least one alternative comprising liquid pump 36 and reservoir 38 outside of the cooler to further maximize available space. However, such reconfiguration might degrade the efficiency of the system, as the liquid in the reservoir would no longer be maintained inside the now-chilled cooler 20. Those of skill in the art will also understand that some coolers may not contain notches or slots 24 for partition, which may be overcome in further alternative embodiments of this disclosure with the use of inserts, straps, fasteners, or friction to secure the internal, thermal exchange module 30.

The cooling liquid loop 34 passes through the drain port 22 outside of the cooler where it comes into contact with the external liquid cooling module. Specifically, the cooling liquid loop 34 most preferably engages in a cross flow conductive heat exchange with a refrigerant loop 52 maintained entirely external to the cooler 20. The refrigerant used in the refrigerant loop 34 can be R134, R600a or other commercially known refrigerants. The external liquid cooling module further contains standard refrigeration cycle components to remove heat from the refrigerant to support the heat exchange process, including an external fan and condenser 54, a refrigeration compressor 56, an evaporator 58, and a throttling device 60, such as a capillary tube, an expansion exchange valve (EXV) or the like.

The power for the internal thermal exchange module 30 and the external liquid cooling module is provided by a power supply unit 80. This power supply unit is most preferably a 12-volt battery of the lithium ion type, though alternative supply source may likewise be used, such as a wall plug or portable car DC supply jack. Additionally, the power can be made still more efficient by the use of a temperature monitoring system (not shown), including one or more temperature sensors or thermistors which can be inserted into the cooler 20, and a microprocessor control unit which communicates electronically with the sensor to turn off or on the power supply to the thermal exchange module 30 and the liquid cooling module depending upon the temperature rising above acceptable temperature set points (e.g., 38 F). Thus, the effective life of the battery supply is greatly increased depending upon the use or lack thereof, e.g., when the cooler remains closed, the temperature will remain relatively constant, and thus the thermal exchange module 30 and the external liquid cooling module will only need to operate a small portion of the time to maintain the set point temperature.

The above description is not intended to limit the meaning of the words used in the following claims that define the invention. Rather, it is contemplated that future modifications in structure, function or result will exist that are not substantial changes and that all such insubstantial changes in what is claimed are intended to be covered by the claims. For instance, the specific voltages and refrigerants and cooling fluids used in the examples of the preferred embodiments of present invention is for illustrative purposes with reference to the example drawings only. Likewise, it will be appreciated by those skilled in the art that various changes, additions, omissions, and modifications can be made to the illustrated embodiments without departing from the spirit of the present invention. All such modifications and changes are intended to be covered by the following claims.

I claim:

1. A modular retrofit unit for retrofit into a cooler with a body having a drain port on the exterior of the body to allow for liquid to drain from the cooler therethrough, the retrofit unit comprising:

a. an internal heat transfer module placed inside of the cooler, the internal heat transfer module processing a closed loop liquid for cooling the interior of the cooler, the internal heat transfer module comprising a radiator, a liquid pump, and a liquid reservoir;

b. an external liquid cooling module external to the outside walls of the cooler, the internal heat transfer module being external to the outside walls of the cooler, the cooler being separate from the body, the external liquid cooling module processing a refrigerant contained within the external liquid cooling module for heat exchange with the closed loop liquid for supply to the internal heat transfer module, the external liquid cooling module comprising a condenser, a refrigeration compressor, an evaporator, and a throttling device;

c. at least one inlet conduit and at least one outlet conduit for moving the closed loop liquid between the external liquid cooling module and the internal heat transfer module during the refrigeration process, wherein the at least one inlet conduit and the at least one outlet conduit can be displaced through the drain port; and d. a power source connected to the external liquid cooling module to drive the internal heat transfer module and the external liquid cooling module.

2. The modular retrofit unit of claim 1, wherein the power source includes a DC power supply.

3. The modular retrofit unit of claim 1, further including a temperature control unit and wherein the interior heat exchange module further includes a sensor, the temperature control unit connected through the drain port to the sensor to provide a user temperature control for the refrigeration.

* * * * *